US006971399B2

(12) United States Patent
Cowan

(10) Patent No.: US 6,971,399 B2
(45) Date of Patent: Dec. 6, 2005

(54) EMERGENCY SUPPLY SYSTEM TO SUPPLANT INTERRUPTED PUBLIC AND PRIVATE UTILITIES

(76) Inventor: LeRoy Frank Cowan, 11015 N. Manor Dr., Highland, UT (US) 84003

( * ) Notice: Subject to any disclaimer, the term of this patent is extended or adjusted under 35 U.S.C. 154(b) by 0 days.

(21) Appl. No.: 10/340,912

(22) Filed: Jan. 10, 2003

(65) Prior Publication Data

US 2004/0134533 A1 Jul. 15, 2004

(51) Int. Cl.[7] ..... F04F 1/06
(52) U.S. Cl. ..... 137/209; 137/357
(58) Field of Search ..... 137/59, 208, 209, 137/357

(56) References Cited

U.S. PATENT DOCUMENTS 2,931,382 A * 4/1960 Cirillo ..... 137/357
3,095,893 A 7/1963 Martin
3,977,474 A 8/1976 Boegli
4,718,452 A 1/1988 Maitland
4,962,789 A 10/1990 Benscotter
5,518,032 A * 5/1996 Berke ..... 137/899.4
6,091,160 A * 7/2000 Kouchi et al. ..... 290/1 A
6,378,546 B1 * 4/2002 Hansen ..... 137/208

* cited by examiner

*Primary Examiner*—Steven M. Hepperle
(74) *Attorney, Agent, or Firm*—Angus C. Fox, III

(57) ABSTRACT

An emergency utility backup system, for a building normally supplied with culinary water, electric power and natural gas by public utilities, includes at least one water storage reservoir having an upper input coupled to a public water utility main line; an electric generator powered by an internal combustion engine; and an electric air compressor having a compressed air storage tank which provides elevated air pressure to the water storage reservoir(s) in the event that water pressure from the public water utility main line fails. The electric air compressor is operable from power supplied by either a public electric utility or said electric generator. The emergency utility backup system may also include a tank for storing a liquid hydrocarbon fuel that may be utilized for both the electric generator and a heating system for the building. Electric power to the building is supplied either from an electric utility source through circuit breakers located within a main circuit breaker panel, of from the electric generator through breakers in a load distribution and transfer switch box.

20 Claims, 2 Drawing Sheets

EMERGENCY SUPPLY SYSTEM TO SUPPLANT INTERRUPTED PUBLIC AND PRIVATE UTILITIES

FIELD OF THE INVENTION

This invention relates, generally, to emergency systems for a supply of water, electric power, and hydrocarbon fuels used for cooking and/or heating. More particularly, the invention relates to such emergency systems having interrelated and shared components.

BACKGROUND OF THE INVENTION

Potable water, electric power and natural gas are typically provided to individual subscribers by public utility companies. The term "public utility" denotes that the public receives either the water, power or gas from the companies, but does not imply that those companies are necessarily publically owned, as they may be either publically or privately owned. In the event of an emergency, such as an earthquake or other catastrophic event, public utility delivery systems for potable water, natural gas, and electric power are likely to be disrupted. If such an emergency event were to occur, a lack of potable water would likely be of most immediate concern. However, if the event were to occur in a time of freezing weather, a lack of natural gas (or an alternative replacement fuel) and/or electric power might conceivably pose a life-threatening situation. In terms of criticality, the most logical order for most foreseeable situations is: firstly, a lack of potable water; secondly, a lack of electric power; and thirdly, unavailability of a hydrocarbon fuel gas such as natural gas, propane, or liquid petroleum gas (LPG). Unavailability of a hydrocarbon fuel gas would, in most cases, be less threatening than a lack of electric power, as electric power may be converted to heat with inexpensive resistance-type electric heaters. However, due to the cost per term of heat generated via electrical resistance, it may be prohibitively expensive to heat an entire house in freezing weather with electrical resistance heating. Thus, it may be desirable to drain all of the water lines in the structure if the supply of natural gas is disrupted for more than several hours during freezing weather, and no alternative supply of a replacement hydrocarbon fuel gas is readily available. However, even with access to a replacement hydrocarbon fuel gas, such as LPG, propane, or butane, most modern forced-air natural gas furnaces are inoperable without electric power.

In U.S. Pat. No. 3,095,893 to J. Martin, an Emergency Water Storage Tank System for Use in Buildings is disclosed. The system includes multiple water tanks having inlet and outlet pipes connected in series, the inlet pipe of the first of the storage tanks being connected to the water main, and the outlet pipes of the storage tanks being connected to the plumbing facilities.

In U.S. Pat. No. 3,977,474 to Boegli, an Emergency Reserve Water and Foam Generating System is disclosed. The system includes a storage tank which is continually replenished form the water main. In the event of fire, a regulated source of high pressure gas is supplied to the tank to expel the water at high pressure through a high expansion foam generator, the foam outlet of which communicates with the spaces of the building or other installation in which the system is installed.

In U.S. Pat. No. 4,718,452 to D. W. Maitland, an Emergency Potable Water Storage System is disclosed. The system includes a generally cylindrical water tank, an inlet and discharge fitting coupled to an opening in the uppermost portion of the tank, a drain fitting coupled to an opening in the lowermost portion of the tank, and a check valve in line with the inlet fitting, which functions as an anti-siphon valve in the event of a pressure drop at the inlet. The inlet fitting is coupled to a faucet via a garden hose.

In U.S. Pat. No. 4,962,789 to K. Benscoter, an Emergency Water Reservoir is disclosed. The reservoir is connected between a municipal water supply line and a hot water heater tank for a building. In times of emergency, water can be drawn directly from the reservoir.

The focus of emergency preparedness has been potable water. What is needed is an integrated emergency backup system for potable water, electricity and heating fuel.

SUMMARY OF THE INVENTION

An integrated emergency back-up system for a building, such as a residence, is provided which includes an electric generator of any type. The electric generator may be powered by an internal combustion engine or by a wind turbine. Alternatively, the electric generator may utilize solar cells, fuel cells, or any other comparable source of electric power. A preferred embodiment of the emergency back-up system includes an electric storage battery which may be charged by the electric generator. In the case of an electric generator powered by an internal combustion engine, the battery provides power to start the engine of the generator when a voltage sensor detects a catastrophic drop in line voltage. In the case of electric generators, such as wind turbines or solar cells, which produce output of variable and unpredictable intensity, the electric storage battery may be used to store power that may be subsequently converted to alternating current on demand. Alternatively, one or more fuel cells may be employed to produce electric power. For one embodiment of the invention, a main circuit breaker may be automatically shut off with, for example, a solenoid, once locally generated or stored electrical power is fed to the building to prevent the locally generated or stored power from being fed into the distribution grid. Alternatively, a manual power transfer switch may be employed. The back-up system may also include a fuel tank for holding a supply of hydrocarbon fuel, which can be used to fuel both the internal combustion engine which drives the generator and the furnace(s) used to heat the building. The back-up system further comprises a holding tank which stores a compressed gas, such as air or carbon dioxide. An electrically-powered air compressor may be employed to maintain a supply of compressed air in the holding tank.

In addition, the back-up system includes at least one water storage reservoir for potable water that is coupled to the water main through an anti-siphon valve. The anti-siphon valve cuts off the connection to the water main when the pressure in the water main drops below a set value, thereby preventing water from the water storage reservoir(s) from being depleted through siphoning. There is also a readily-accessible shut-off valve (in addition to the water utility shut-off valve next to the water meter), with which the supply water from the municipal water supply may be cut if, for example, it is contaminated. With the municipal water supply cut off, water for the building is drawn from the water storage reservoirs. Until the municipal water supply is considered safe, or restored, the water in the water storage reservoirs can be replenished from safe sources. Each water storage reservoir is equipped with a first hose bib or valve and connector, at the top thereof, through which the reservoir may be filled from a truck-mounted tank or other replenishing system, and a second hose bib or valve and connector at the bottom thereof, through which the reservoir maybe drained. If multiple water storage reservoirs are used, they are coupled in series so that water flows from the first to the second, the second to the third, and so on, thereby ensuring that each reservoir is continually replenished with a supply of non-stagnant water from the water main during periods of normal daily operation. Compressed air from the holding tank is fed to the first water storage reservoir so as to provide water pressure for the stored emergency water. Alternatively, pressurization of stored potable water may be accomplished with a liquified pressurized gas, such as carbon dioxide, or any other source of pressurization.

The gas line to the building may incorporate a seismic shut-off valve. If the seismic shut-off valve is actuated, it must be manually reset to ensure that any gas leaks in the building are repaired before the gas supply is restored. In addition, a sensor in the natural gas main detects the loss of gas pressure and switches the gas line to the building from the main line to the fuel tank until pressure is restored. The switches may be solenoid controlled. Power from the battery or fuel cell(s) supplies the power for switch activation. In order to keep local power generation requirements at an acceptable level, back-up electric power is fed to only selected circuit breakers, which ensures that a maximum load will not exceed the rated capacity of the back-up generator. Such selected circuit breakers may include lighting circuits, circuits used for gas furnace operation, an air compressor circuit, circuits used for microwave ovens, and other essential circuits having relatively low loads. Those which most likely will not be connected to back-up electric power include high-amperage circuits used for appliances such as electric hot-water heaters, ovens and ranges, and electric clothes dryers.

PREFERRED EMBODIMENT OF THE INVENTION

Figure 1:
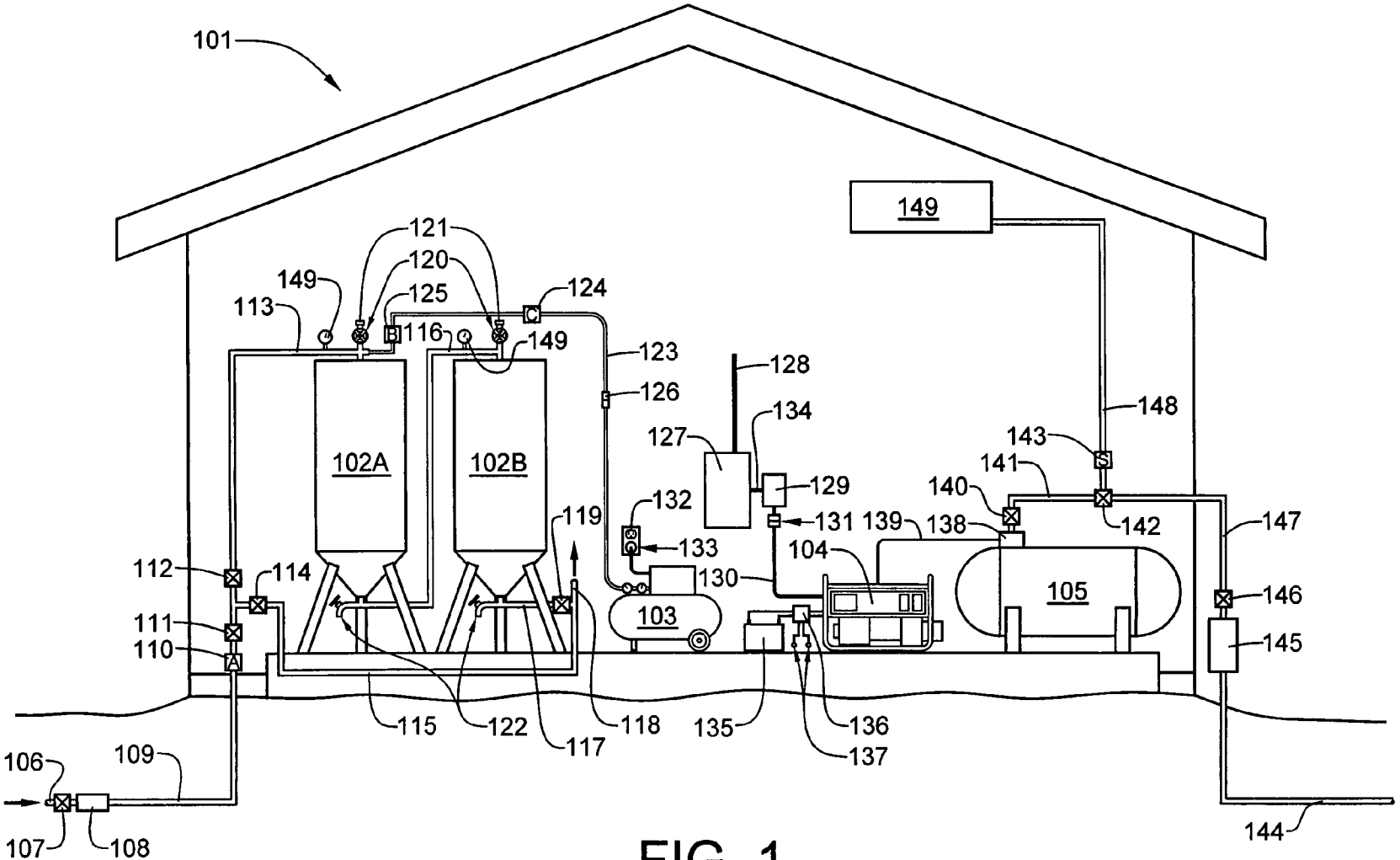
FIG. 1 is a side elevational view of a building having a preferred embodiment of an integrated utilities back-up system.

Referring now to FIG. 1, a preferred embodiment of an integrated emergency back-up system for a building, such as a residence 101, that is normally supplied with culinary water, electric power and natural gas by one or more public utility companies, includes a pair of series connected water storage reservoirs 102A and 102B, an air compressor 103, an electric generator 104, a fuel storage tank 105 for liquid hydrocarbon fuel. The electric generator may be powered by an internal combustion engine, a wind turbine, or any other available source of rotational energy. Alternatively, the electric generator may utilize solar cells or fuel cells.

As most residential heating systems (furnaces) are fired by natural gas provided by a utility distribution grid, it would be ideal if natural gas could be stored in quantities sufficient to meet emergency demands. However, the major component of natural gas is methane, and long-term storage of liquified methane is impractical, at best, as it condenses at a temperature of approximately −162° C. (−260° F.). Hydrocarbon fuels for emergency supplies must, therefore, be limited to those which can be safely stored as liquids at ambient temperatures. Such fuels include Liquid Petroleum Gas (LPG), ethanol, kerosene and diesel fuel. LPG is the generic name for commercial propane and commercial butane. These are hydrocarbon products produced by the oil and gas industries. Commercial Propane predominantly consists of hydrocarbons containing three carbon atoms, mainly propane ($C_3H_8$), while commercial butane predominantly consists of hydrocarbons containing four carbon atoms, mainly n- and iso-butanes ($C_4H_{10}$). They have the special properties of becoming liquid at atmospheric temperature if moderately compressed, and reverting to gases when the pressure is sufficiently reduced. Compressed, liquified LPG is roughly 250 times as dense as when gasified. Butane is usually supplied to customers in cylinders; propane can be supplied either in cylinders or in bulk for storage in tanks at the customer's premises.

Most residential heating systems can be converted, by adjusting the size of the gas jets, to burn either natural gas or LPG. As most electronically-controlled furnaces require accurate adjustment of fuel delivery rates to properly function, or even function at all, a switch from a natural gas supply to a propane supply would necessarily require a concurrent installation of gas jets sized for efficient use of propane as a fuel. The use of ethanol, kerosene or diesel fuel as a furnace fuel would require the use of heating equipment dedicated to the use of that fuel. In order to minimize the expense of implementing an emergency back-up system, a gas furnace operable with natural gas in a normal mode, and with LPG as a back-up fuel, is considered the most cost-effective equipment.

Still referring to FIG. 1, the water storage reservoirs 102A/102B and the air compressor 103 are the major components of an emergency potable water storage system. Potable water, which is received from the municipal water main 106 through a first shut-off valve 107 and a water meter 108, is transported to the building 101 via a service pipe 109. The water passes through an anti-siphon valve 110, which cuts off the connection to the water main when the pressure in the water main drops below a set value, thereby preventing water from either the building's plumbing or from the water storage reservoir(s) 102A/102B from being drawn into the water main 106 by siphon action. From the anti-siphon valve 110, the water passes through a second shut-off valve 111. The second shut-off valve 111 is a readily accessible valve which can be used to isolate the residence 101 from the municipal water supply if, for example, the municipal water supply is contaminated. With the municipal water supply cut off, water for the residence 101 is drawn from the water storage reservoirs 102A/102B. Until the municipal water supply is considered safe, the water in the water storage reservoirs 102A/102B can be replenished from safe sources. From the second shut-off valve 111, the water is transported either through a third shut-off valve 112 into an emergency water feed line 113, or through a fourth shut-off valve 114 into a bypass line 115, which delivers potable water to the building's plumbing directly from the municipal water main 106. If the water is routed through the emergency water feed line 113, it enters the top of the first water storage reservoir 102A. The bottom of the first water storage reservoir 102A is coupled to the top of the second water storage reservoir 102B via an interconnect line 116. An output line 117 couples the bottom of the second water storage reservoir 102B to the building feed line 118. An isolation valve 119 permits the water storage reservoirs 102A and 102B to be isolated from the building feed line 118 in the event of a leak or need to repair the reservoirs or connecting plumbing. The top of each water storage reservoir (102A and 102B) is fitted with a fill valve 120 and a hose bib 121, which permits each reservoir to be filled from a tanker truck or other similar portable source. Likewise, the bottom of each water storage reservoir is fitted with a drain valve 122, which permits each water storage reservoir (102A or 102B) to be manually drained. A high-pressure air line 123 connects the air compressor 103 to the top of the first water storage reservoir 102A, so that water pressure can be maintained for emergency potable water stored in the first water storage reservoir 102A and the second water storage reservoir 102B. It will be noted that a pressure gauge 149 is installed in both the emergency water feed line 113 and the interconnect line 116, so that air pressure within each water storage reservoir 102A or 102B may be monitored. If more than two water storage reservoirs are used, they are coupled in series so that water flows from the first to the second, the second to the third, and so on, thereby ensuring that each reservoir is continually replenished with a supply of non-stagnant water from the water main during every-day, non-emergency-mode operation. A one-way check valve 124 prevents water from flowing through the high-pressure air line 123 and into the tank of the air compressor 103 if the tank is not pressurized to a value greater than the line service pressure. In addition a bleed valve 125 allows air pressure to be released from the high-pressure air line 123 for gravity draining of the water storage reservoirs 102A and 102B through drain valve 122. Furthermore, a quick disconnect union 126 in the high-pressure air line 123 allows quick decoupling of the air compressor 103 from the emergency back-up system.

Still referring to FIG. 1, power for the building 101 is normally received at a main disconnect/circuit breaker box 127 from an electric utility company through a municipal electric main supply line 128 feeds a main breaker box 127. However, backup electric power from the electric generator 104 is not routed directly to the main disconnect/circuit breaker box 127, but rather is routed to a load distribution and transfer switch box 129 via a back-up electrical supply line 130 through a first quick-disconnect electrical connector 131, which allows the electric generator 104 to be disconnected from the load distribution box 129 and used for other applications, such as camping or construction work, when power from the electric utility company through the municipal electric main supply line 128 is available. Essential circuits for the building 101 are routed into the load distribution box 129. It will be noted that the air compressor is coupled to electrical circuit 132. A second quick-disconnect electrical connector 133, such as a standard three-prong plug, permits the air compressor 103 to be quickly disconnected from electrical circuit 132 so that the air compressor 103 may be used for other tasks when not needed to provide water pressure for the emergency potable water supply. From the load distribution and transfer switch box 129, power is fed to only selected circuit breakers in the main disconnect/circuit breaker box 127 through a conduit coupling 134. By feeding backup power to only selected essential circuits, on-site emergency power generation requirements are minimized so that power demand will not exceed the rated capacity of the electric generator 104. This will be subsequently explained in greater detail with reference to FIG. 2 of the drawings. For a preferred embodiment of the emergency back-up system, the electric generator 104 is also coupled to an electrical storage battery 135 through a rectifier 136, which enables the charge on the battery 135 to be maintained by the electric generator 104. The rectifier 136 also permits charging of the electrical storage battery 135 with electrical power received through the municipal electric main supply line 128. The battery 135 may be utilized to start the internal combustion engine of the electric generator 104, or may be used for various solenoid switching tasks related to power distribution and the selection of particular fuel sources. Through terminals 137, other alternating current power sources, such as generators or alternators driven by wind, hydroelectric, or steam turbines, may be coupled to the electrical storage battery 135. The power stored in the battery 135 may also be converted to alternating current with a DC-AC converter (not shown) and used to power certain devices within the building 101. It should also be understood a fuel cell may replace the battery 135 under circumstances where sporadically generated electric current (as, for example, from a wind turbine) need not be stored. It is well known in the art that fuel cells produce direct current.

Still referring to FIG. 1, the fuel storage tank 105 includes a pressure regulator 138, through which fuel is delivered to the internal combustion engine of the electric generator 104 through a generator fuel supply tine 139, and to the gas lines of the building 101 through an auxiliary gas shut-off valve 140, an emergency gas supply line 141, a router valve 142, and a seismic gas shut-off valve 143. The later protects the building 101 from explosive conditions which might result from leaks in gas lines caused by earthquakes of significant magnitude. Many examples of seismic shut-off valves are known in the art, and are typically reset manually, thereby ensuring that any gas leaks in the building will be repaired before the gas supply is restored thereto. The municipal gas main 144 is coupled to a gas meter 145 and to a main gas shut-off valve 146. Natural gas passing through the main gas shut-off valve 146 is fed to the router valve 142 and the seismic shut-off valve 143 through a non-emergency gas supply line 147. Gas feed line 148 feeds gas to a furnace 149 within the building 101.

Still referring to FIG. 1, the router valve 142 may be manually operated, or it may contain a sensor which detects a loss of gas pressure in the municipal gas main 144, and automatically switches the gas supply from the municipal gas main 144 to the fuel storage tank 105 until pressure in the municipal gas main 144 is restored. The router valve 142 may be solenoid controlled. Power from either the battery or the municipal electric grid supplies the power for switch activation.

Figure 2:
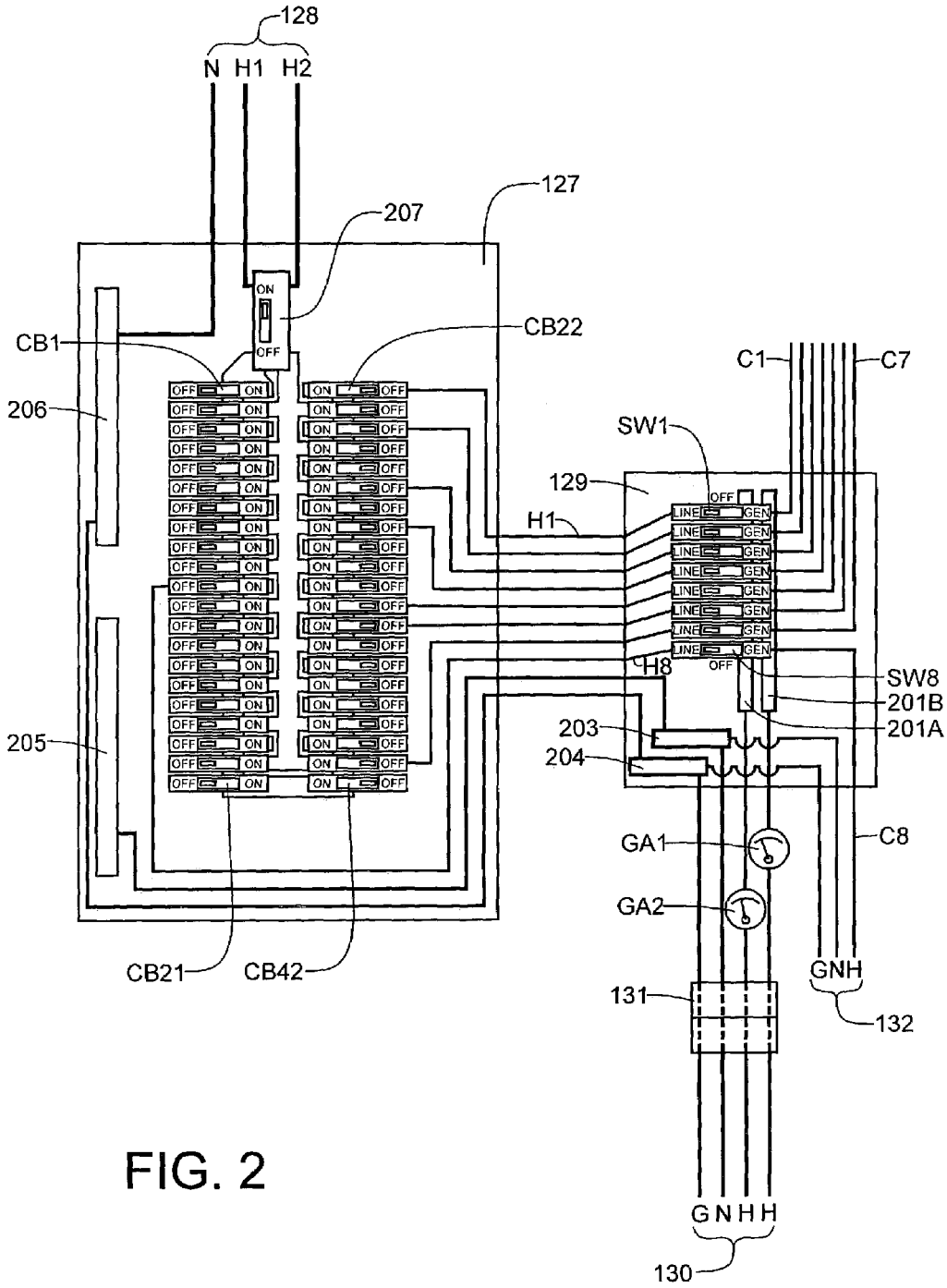
FIG. 2 is a schematic of the electrical portion of the integrated utilities back-up system.

Referring now to FIG. 2, in order to keep on-site emergency power generation requirements at an acceptable level, back-up electric power is fed to only selected circuit breakers, which ensures that a maximum load will not exceed the rated capacity of the back-up generator. Such an arrangement is achieved by routing the output from the generator 104, that is carried by the backup electrical supply line 130, to the load distribution box 129. The first quick-disconnect electrical connector 131 allows the electric generator 104 to be disconnected from the backup electrical supply line 130 and from the emergency back-up system. An exemplary load distribution box 129 contains eight three-position disconnect switches SW1 through SW8. Odd numbered switches (i.e., SW1, SW3, SW5 and SW7) are connected to the first backup hot bus bar 201A, while even numbered switches (i.e., SW2, SW4, SW6, and SW8) are connected to the second backup hot bus bar 201B. The central switch position is "POWER OFF". On one side of the "OFF" position is the "LINE" position, which supplies electrical power to that circuit from the public utility. On the opposite side of the "OFF" position is the generator or "GEN" position, which supplies backup power to that circuit from the electric generator 104. The "GEN" position of each switch SW1 through SW8 includes an internal circuit breaker (not shown) for protecting the generator from electrical overloads. The hot wire of eight essential circuits C1 through C8 are shown. Hot wire C8 pertains to the electrical circuit 132, which is used for the air compressor and possibly the gas furnace. Each of the eight hot wires C1 through C8 has associated therewith a neutral wire N and a ground wire G. However, the neutral and ground wires of only electrical circuit 132 are shown in this simplified schematic. A hot connector wire H1 through H8 respectively connects the "LINE" output from each three position switch SW1 through SW8 to an associated circuit breaker in the main disconnect/circuit breaker box 127. Ampere gauges GA1 and GA2 measure amperage draw on each hot leg output of the electric generator 104, so that relative load balance may be achieved between the two output legs.

Still referring to FIG. 2, an exemplary main disconnect/circuit breaker box 127 contains forty-two circuit breakers CB1 through CB42, twenty-one of which (CB1 through CB21) are located on the left side of the panel, and twenty-one of which (CB22 through CB42) are located on the right side of the panel. As shown in the drawing FIG. 2, power from the three-position switches SW1 through SW8 is fed to circuit breakers CB22, CB24, CB27, CB29, CB33, CB34, CB41, and C11, respectively. The selected circuit breakers may provide power to circuits used for lighting, microwave oven(s), gas furnace control, the air compressor 103, and other essential circuits having relatively low-resistance loads. Those which most likely will not be connected to back-up electric power include high-amperage circuits used for appliances with electrical resistance heating, such as electric hot-water heaters, ovens and ranges, and electric clothes dryers.

Although only several embodiments of the emergency supply system have been heretofore described, it will be obvious to those having ordinary skill in the art that changes and modifications may be made thereto without departing from the scope and the spirit of the invention as hereinafter claimed.

What is claimed is:

1. An emergency utility backup system for a building normally supplied with culinary water, electric power and natural gas by public utilities, said system comprising:

at least one water storage reservoir having an upper input coupled to a public water utility main line, and a lower output coupled to the building's culinary water plumbing;

an electric generator; and a storage tank, containing at least one compressed gas, coupled to said upper input, which provides culinary water pressure for water stored in said at least one water storage tank in the event that water pressure from the public water utility main line fails.

2. The emergency utility backup system of claim 1, wherein said at least one compressed gas is provided by an electric air compressor coupled to said storage reservoir, said electric air compressor operable from power supplied by either a public electric utility or said electric generator.

3. The emergency utility backup system of claim 1,, which further comprises an anti-siphon valve interposed between said upper input and the public water utility main line.

4. The emergency utility backup system of claim 1, which further comprises a tank for storing a liquid hydrocarbon fuel, and said electric generator is powered by an engine fueled by the stored liquid hydrocarbon fuel.

5. The emergency utility backup system of claim 4, which further comprises a furnace for heating the building, which is adapted to burn the stored liquid hydrocarbon fuel.

6. The emergency utility backup system of claim 1, which further comprises a first quick-release electrical connector, which enables said electric generator to be rapidly decoupled from the emergency utility backup system without the use of tools, so that it may be employed for unrelated tasks when no emergency utility backup is required.

7. The emergency utility backup system of claim 6 which further comprises a second quick-release electrical connector, which enables said electric air compressor to be rapidly decoupled from the emergency utility backup system without the use of tools, so it may be employed for unrelated tasks.

8. The emergency utility backup system of claim 2, which further comprises at least one main circuit breaker panel fed by power supplied by the public electric utility, electric power to the building being supplied through circuit breakers located within said at least one main circuit breaker panel, and a load distribution box fed by power supplied by the electric generator, said load distribution box having a plurality of auxiliary circuit breakers, through each of which power from the electric generator is routed to individual essential circuits in the main circuit breaker panel.

9. The emergency utility backup system of claim 8, wherein said individual essential circuits do not include those in the main circuit breaker panel which feed high-amperage resistance heating circuits.

10. The emergency utility backup system of claim 1, wherein the top of each water storage reservoir is equipped with a valve having a hose connector, which enable said water storage reservoir to be filled from an auxiliary source.

11. The emergency utility backup system of claim 10, wherein the bottom of each water storage reservoir is equipped with a drain valve, which enables said water storage reservoir to be gravity drained.

12. The emergency utility backup system of claim 8, wherein said air compressor is powered by an essential circuit which is supplied with emergency power from the electric generator through an auxiliary circuit breaker.

13. An emergency utility backup system for a building normally supplied with culinary water, electric power and natural gas by public utilities, said system comprising:

at least one water storage reservoir having an upper input coupled to a public water utility main line via an anti-siphon valve, and a lower output functioning as a building feed line;

an electric generator for providing emergency electric power to the building; and an electric air compressor having a compressed air storage tank coupled to said upper input, which provides culinary water pressure for water stored in said at least one water storage reservoir in the event that water pressure from the public water utility main line fails, said electric air compressor being operable from power supplied by either a public electric utility or said electric generator.

14. The emergency utility backup system of claim 13, which further comprises a tank for storing a liquid hydrocarbon fuel, and said electric generator is powered by an engine fueled by the stored liquid hydrocarbon fuel.

15. The emergency utility backup system of claim 14, which further comprises a furnace for heating the building, which is adapted to burn the stored liquid hydrocarbon fuel.

16. The emergency utility backup system of claim 13, which further comprises a first quick-release electrical connector, which enables said electric generator to be rapidly decoupled from the emergency utility backup system without the use of tools, so that it may be employed for unrelated tasks when no emergency utility backup is required.

17. The emergency utility backup system of claim 16 which further comprises a second quick-release electrical connector, which enables said electric air compressor to be rapidly decoupled from the emergency utility backup system without the use of tools, so it may be employed for unrelated tasks.

18. The emergency utility backup system of claim 13, which further comprises at least one main circuit breaker panel fed by power supplied by the public electric utility, electric power to the building being supplied through circuit breakers located within said at least one main circuit breaker panel, and a load distribution box fed by power supplied by the electric generator, said load distribution box having a plurality of auxiliary circuit breakers, through each of which power from the electric generator is routed to individual essential circuits in the main circuit breaker panel.

19. The emergency utility backup system of claim 18, wherein said air compressor is powered by an essential circuit supplied with emergency power from the electric generator through an auxiliary circuit breaker, and wherein said individual essential circuits do not include those in the main circuit breaker panel which feed high-amperage resistance heating circuits.

20. The emergency utility backup system of claim 13, wherein the top of each water storage reservoir is equipped with a valve having a hose connector, which enable said water storage reservoir to be filled from an auxiliary source, and wherein the bottom of each water storage reservoir is equipped with a drain valve, which enables said water storage reservoir to be gravity drained.

* * * * *